US011428369B2

(12) United States Patent
Park et al.

(10) Patent No.: US 11,428,369 B2
(45) Date of Patent: Aug. 30, 2022

(54) LIQUEFIED GAS STORAGE TANK HAVING INSULATION PARTS AND METHOD FOR ARRANGING INSULATION PARTS

(71) Applicant: DAEWOO SHIPBUILDING & MARINE ENGINEERING CO., LTD., Seoul (KR)

(72) Inventors: Seong Woo Park, Geoje-si (KR); Kwang Jun Park, Seoul (KR); Joong Kyoo Kang, Geoje-si (KR)

(73) Assignee: DAEWOO SHIPBUILDING & MARINE ENGINEERING CO., LTD., Seoul (KR)

( * ) Notice: Subject to any disclaimer, the term of this patent is extended or adjusted under 35 U.S.C. 154(b) by 377 days.

(21) Appl. No.: 15/744,708

(22) PCT Filed: Apr. 22, 2016

(86) PCT No.: PCT/KR2016/004220
§ 371 (c)(1),
(2) Date: Jan. 12, 2018

(87) PCT Pub. No.: WO2017/010661
PCT Pub. Date: Jan. 19, 2017

(65) Prior Publication Data

US 2018/0209586 A1 Jul. 26, 2018

(30) Foreign Application Priority Data

Jul. 13, 2015 (KR) ..... 10-2015-0099001

(51) Int. Cl.
*F17C 3/00* (2006.01)
*F17C 3/02* (2006.01)
(Continued)

(52) U.S. Cl.
CPC ..... *F17C 1/12* (2013.01); *B63B 25/16* (2013.01); *F17C 3/02* (2013.01); *F17C 3/025* (2013.01);
(Continued)

(58) Field of Classification Search
CPC .... B63B 25/16; F17C 1/12; F17C 3/02; F17C 3/025; F17C 3/027; F17C 13/001;
(Continued)

(56) References Cited

U.S. PATENT DOCUMENTS 2,896,416 A * 7/1959 Henry ..... B63B 25/16 62/53.2
2,916,179 A * 12/1959 Monroe ..... F17C 13/001 220/560.1
(Continued)

FOREIGN PATENT DOCUMENTS

JP 62-194098 A 8/1987
JP 2008-531941 A 8/2008
(Continued)

OTHER PUBLICATIONS

Machine Translation of KR 101215473—Published Dec. 26, 2012 (Year: 2021).*
(Continued)

*Primary Examiner* — Gideon R Weinerth
(74) *Attorney, Agent, or Firm* — Knobbe, Martens, Olson & Bear, LLP

(57) ABSTRACT

A liquefied gas storage tank having insulation parts and a method for arranging the insulation parts are disclosed. Disclosed are the liquefied gas storage tank having the insulation parts and the method for arranging the insulation parts, the liquefied gas storage tank being capable of improving durability against the impact generated by liquefied gas since insulation panels, which are arranged in the insulating
(Continued)

parts for the liquefied gas storage tank, have different densities according to: a load due to the mass of the liquefied gas stored in the liquefied gas storage tank; and the impact generated by sloshing.

21 Claims, 2 Drawing Sheets

(51) Int. Cl.
*B63B 25/00* (2006.01)
*F17C 1/12* (2006.01)
*B63B 25/16* (2006.01)
*F17C 13/00* (2006.01)

(52) U.S. Cl.
CPC ..... *F17C 3/027* (2013.01); *F17C 13/001* (2013.01); *F17C 2203/0333* (2013.01); *F17C 2221/033* (2013.01); *F17C 2221/035* (2013.01); *F17C 2223/0161* (2013.01); *F17C 2260/016* (2013.01); *F17C 2270/0105* (2013.01)

(58) Field of Classification Search
CPC ..... F17C 2203/0333; F17C 2221/0333; F17C 2221/035; F17C 2270/0105; F17C 2270/0107; F17C 2223/0161; F17C 2223/033; F17C 2223/043; F17C 2260/016; F17C 2260/033; F17C 2203/0354; F17C 2203/0631; F17C 2221/033
USPC .... 220/560.08, 560.06, 560.15, 562, 560.04, 220/901, 902; 114/74 R, 74 A, 79 R, 80, 114/536
See application file for complete search history.

(56) References Cited

U.S. PATENT DOCUMENTS 2,994,452 A * 8/1961 Morrison ..... F17C 3/022 220/560.08
3,155,266 A * 11/1964 Katsuro ..... F17C 3/027 220/560.06
3,367,492 A * 2/1968 Pratt ..... F17C 13/001 220/560.07
3,489,311 A * 1/1970 Burgoa ..... F17C 13/126 220/592.25
3,490,639 A * 1/1970 Gibson ..... B63B 25/16 220/560.05
3,502,239 A * 3/1970 Estebanez ..... F17C 3/025 220/560.15
3,547,047 A * 12/1970 Needham ..... F17C 3/04 105/358
3,547,301 A * 12/1970 Ffooks ..... B63B 25/16 114/343
3,595,424 A * 7/1971 Jackson ..... F17C 3/025 220/562
3,655,086 A * 4/1972 Trenner ..... F17C 3/04 220/560.05
3,757,982 A * 9/1973 Isenberg ..... F17C 13/126 220/560.15
3,830,396 A * 8/1974 Jackson ..... F17C 3/025 220/560.07
3,895,159 A * 7/1975 Yoshimura ..... B32B 7/12 442/224
3,904,068 A * 9/1975 Beaujean ..... B63B 25/16 220/560.15
3,927,788 A * 12/1975 Zinniger ..... F17C 3/025 220/560.05
3,929,247 A * 12/1975 Borup ..... B65D 81/18 220/560.15
3,931,908 A * 1/1976 Cheyney ..... B65D 25/14 220/560.15
3,974,935 A * 8/1976 Ffooks ..... F17C 3/022 220/560.05
3,993,213 A * 11/1976 Burge ..... B65D 90/06 220/560.08
4,009,236 A * 2/1977 Katsuta ..... F17C 13/001 264/45.3
4,032,608 A * 6/1977 Zinniger ..... F17C 3/025 264/46.6
4,119,241 A * 10/1978 Furuta ..... F17C 3/025 114/74 A
4,135,465 A * 1/1979 Dudley ..... B63B 25/12 114/74 A
4,170,952 A * 10/1979 McCown ..... F17C 13/001 220/560.08
4,199,909 A * 4/1980 Kotcharian ..... B65D 90/06 114/65 R
4,452,162 A * 6/1984 Harbaugh ..... B63B 25/16 114/74 A
5,476,189 A * 12/1995 Duvall ..... F17C 1/16 220/588
5,727,492 A * 3/1998 Cuneo ..... B63B 25/16 114/74 A
5,797,513 A * 8/1998 Olinger ..... F17C 3/04 220/592.27
6,378,722 B1 * 4/2002 Dhellemmes ..... B65D 90/06 220/651
6,786,166 B1 9/2004 Marchand et al.
7,469,651 B2 * 12/2008 Sandstrom ..... F17C 1/002 114/69
8,082,867 B2 * 12/2011 Koole ..... B63B 25/12 114/74 R
9,335,003 B2 * 5/2016 Shin ..... B63B 25/16
9,950,830 B2 * 4/2018 de Lesseux ..... B65D 5/60
10,458,597 B2 * 10/2019 Joh ..... F17C 3/027
2007/0181586 A1 * 8/2007 Van Ootmarsum ..... F17C 3/06 220/592.26
2007/0245941 A1 * 10/2007 Sandstrom ..... F17C 13/082 114/74 R
2011/0056954 A1 * 3/2011 Joh ..... B63B 25/16 220/560.07
2014/0174333 A1 * 6/2014 Morimoto ..... F17C 13/082 114/74 A
2014/0299038 A1 10/2014 Shin et al.
2017/0198863 A1 * 7/2017 Hirai ..... F17C 3/027
2017/0292652 A1 * 10/2017 Delanoe ..... B67D 9/00
2018/0209586 A1 * 7/2018 Park ..... F17C 1/12
2020/0318790 A1 * 10/2020 Park ..... B63B 25/16
2021/0323642 A1 * 10/2021 Park ..... F17C 3/027

FOREIGN PATENT DOCUMENTS

KR 10-2009-0131329 A 12/2009
KR 10-2011-0133658 A 12/2011
KR 10-2012-0003411 A 1/2012
KR 10-2012-0013247 A 2/2012
KR 101215473 B1 12/2012
KR 101375263 B1 3/2014

OTHER PUBLICATIONS

Extended European Search Report of corresponding European Patent Application No. 16824578.5—7 pages (dated Jan. 24, 2019).
Office Action of corresponding Japanese Patent Application No. 2018-521155—4 pages (dated Jan. 8, 2019).
International Search Report dated Aug. 1, 2016 in PCT/KR2016/004220 and its English translation—4 pages.
Office Action of corresponding Korean Patent Application No. 10-2015-0099001—8 pages (dated Aug. 3, 2021).

* cited by examiner

【FIG. 1】
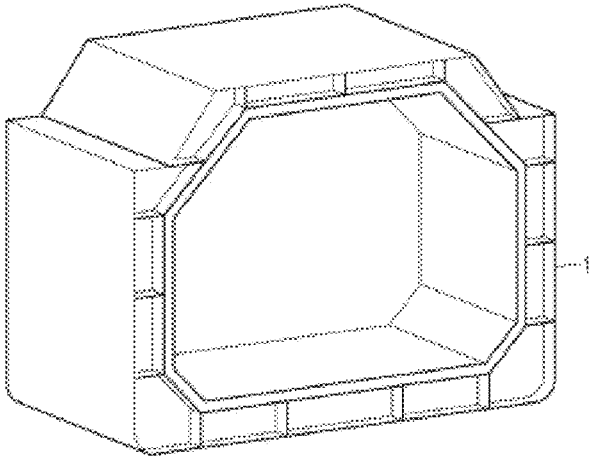
【FIG. 2】
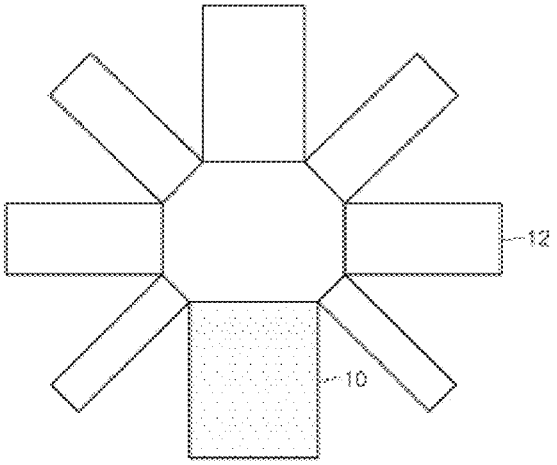
【FIG. 3】
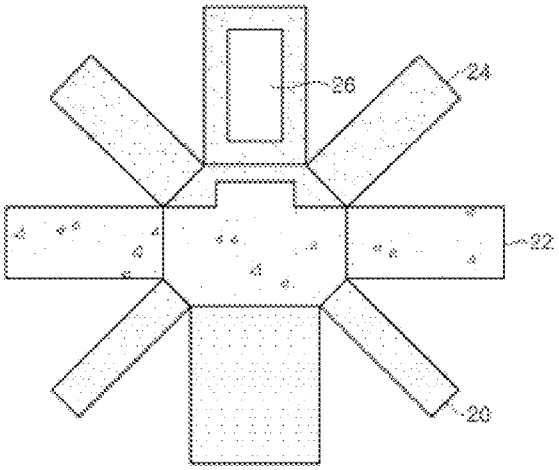

【FIG. 4】
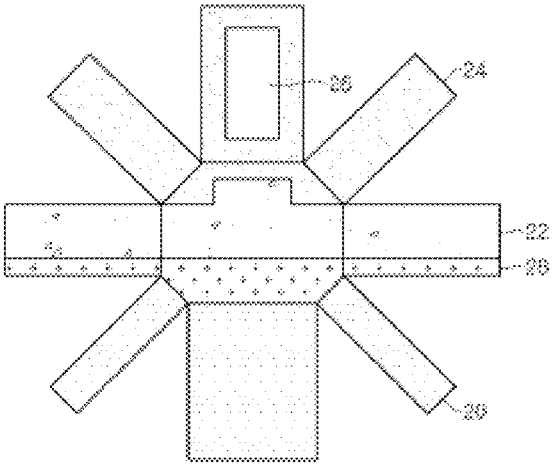

LIQUEFIED GAS STORAGE TANK HAVING INSULATION PARTS AND METHOD FOR ARRANGING INSULATION PARTS

TECHNICAL FIELD

The present invention relates to a liquefied gas storage tank including a heat insulation part and a method of arranging the heat insulation part, and more particularly, to a liquefied gas storage tank which includes a heat insulation part and can be manufactured at a reduced cost, and a method of arranging the heat insulation part.

BACKGROUND ART

Since liquefied gas such as liquefied natural gas (LNG) is in a liquid state at a cryogenic temperature under atmospheric pressure, a separate tank capable of storing liquefied gas at a cryogenic temperature is required to transport the liquefied gas.

Such a liquefied gas storage tank includes a heat insulation part to prevent liquefied gas from evaporating due to heat exchange with the outside.

A liquefied gas storage tank is divided into an independent storage tank and a membrane-type storage tank depending on whether a heat insulation part directly receives a load of liquefied gas. In other words, in the independent storage tank, the heat insulation part does not directly receive the load of the liquefied gas, whereas, in the membrane-type storage tank, the heat insulation part directly receives the load of the liquefied gas.

A membrane type storage tank is divided into a NO96 type storage tank and a Mark III type storage tank.

DISCLOSURE

Technical Problem

A typical membrane-type storage tank is provided throughout the entire surface thereof with heat insulation panels having the same properties (i.e., the same densities) to achieve only the original purpose, i.e., insulation of liquefied gas from the outside.

A liquefied gas storage tank is continuously impacted by sloshing. Here, "sloshing" refers to movement of a fluid with respect to a tank containing the fluid. During transportation of the fluid, sloshing in the tank can impact and damage to the tank. In other words, impact on the liquefied gas storage tank can be divided into (a) impact due to a load of liquefied gas and (b) impact due to sloshing of the liquefied gas.

A membrane type storage tank, which includes a heat insulation part directly receiving a load of the liquefied gas, includes a portion heavily impacted by sloshing and a portion less impacted by sloshing. If heat insulation panels having the same strengths are disposed over the entire surface of the storage tank without considering this, (1) the portion of the storage tank heavily impacted by sloshing is relatively vulnerable, and (2) the portion of the storage tank less impacted by sloshing causes over-consumption of a heat insulation material.

Therefore, embodiments of the present invention provide a membrane type storage tank which includes a heat insulation part, specifically optimally-disposed heat insulation panels, by taking into account liquefied gas-induced impact on the storage tank.

Technical Solution

In accordance with one aspect of the present invention, there is provided a liquefied gas storage tank including a heat insulation part, wherein the heat insulation part includes a plurality of regions in which heat insulation panels having different densities are disposed, respectively, the plurality of regions being divided based on impact on the storage tank due to a load of liquefied gas and sloshing of the liquefied gas.

The plurality of regions may include: a first density region formed on a bottom surface of the storage tank; and a second density region formed on upper and side surfaces of the storage tank.

A heat insulation panel disposed in the second density region may have a higher density than a heat insulation panel disposed in the first density region.

The plurality of regions may include: a third density region formed on a bottom surface of the storage tank; a fourth density region formed on front, side and back surfaces of the storage tank; and a fifth density region formed on an upper surface of the storage tank.

A heat insulation panel disposed in the fifth density region may have a higher density than a heat insulation panel disposed in the fourth density region, and a heat insulation panel disposed in the third density region may have a lower density than a heat insulation panel disposed in the fourth density region.

The plurality of regions may further include: a sixth density region formed at a central portion on the upper surface of the storage tank to be surrounded by the fifth density region.

A heat insulation panel disposed in the sixth density region may have a lower density than a heat insulation panel disposed in the fifth density region.

The plurality of regions may further include: a seventh density region formed on a portion of each of the front, side and back surfaces of the storage tank below the fourth density region.

A heat insulation panel disposed in the seventh density region may have a higher density than a heat insulation panel disposed in the fourth density region.

The fourth density region may protrude upwardly toward the fifth density region.

The liquefied gas storage tank may be a membrane-type storage tank.

In accordance with another aspect of the present invention, there is provided a method of arranging a heat insulation part for a liquefied gas storage tank, including: dividing the heat insulation part into a first region under a load of liquefied gas; a second region impacted by sloshing of the liquefied gas; and a third region other than the first region and the second region; and disposing heat insulation panels in the first to third regions, respectively, such that a heat insulation panel disposed in the second region has a higher density than a heat insulation panel disposed in the first region and a heat insulation panel disposed in the third region has a higher density than the heat insulation panel disposed in the first region.

The heat insulation part may include reinforced polyurethane foam (R-PUF).

Advantageous Effects

According to embodiments of the present invention, in a heat insulation part for a membrane-type storage tank, a heat insulation panel disposed at a portion of the storage tank heavily impacted by sloshing of liquefied gas has a different density than a heat insulation panel disposed at a portion of the storage tank less impacted by sloshing, thereby improving durability of the storage tank against impact due to liquefied gas.

In addition, according to the embodiments of the present invention, a portion of the heat insulation part disposed at a portion of the storage tank less affected by a load of liquefied gas or impact due to the liquefied gas is composed of a heat insulation panel having a relatively low density, thereby enabling optimal use of a heat insulation material.

DESCRIPTION OF DRAWINGS

FIG. 1 is a perspective view of an exemplary liquefied gas storage tank to which the present invention is applied.

FIG. 2 is a development view of a heat insulation part for a liquefied gas storage tank according to a first embodiment of the present invention.

FIG. 3 is a development view of a heat insulation part for a liquefied gas storage tank according to a second embodiment of the present invention.

FIG. 4 is a development view of a heat insulation part for a liquefied gas storage tank according to a third embodiment of the present invention.

BEST MODE

Hereinafter, embodiments of the present invention will be described with reference to the accompanying drawings. However, it should be understood that the present invention is not limited to the following embodiments, and that various modifications and equivalent embodiments may be made by those skilled in the art. Therefore, the scope of the present invention is defined only by the claims.

FIG. 1 is a perspective view of an exemplary liquefied gas storage tank to which the present invention is applied.

Referring to FIG. 1, the liquefied gas storage tank 1 may be a membrane-type storage tank. FIGS. 2 to 4 are development views of the liquefied gas storage tank, respectively. In FIGS. 2 to 4, different hatchings indicate different regions, specifically regions of a heat insulation part where heat insulation panels having different densities are disposed, respectively.

Although a front portion of the liquefied gas storage tank 1 is omitted to illustrate the interior of the liquefied gas storage tank 1 in FIGS. 1 to 4, it should be understood that, a front surface of a heat insulation part for a liquefied gas storage tank shown in each of FIGS. 2 to 4 is configured in the same manner as a back surface of the heat insulation part.

A heat insulation panel described below may be formed of reinforced polyurethane foam (R-PUF).

FIG. 2 is a development view of a heat insulation part for a liquefied gas storage tank according to a first embodiment of the present invention.

Referring to FIG. 2, the heat insulation part for the liquefied gas storage tank according to the first embodiment includes a bottom surface, an upper surface, side surfaces consisting of a right-side surface and a left-side surface, a front surface, and a back surface. In addition, the heat insulation part for the liquefied gas storage tank further includes a lower chamfered surface between each of the side surfaces and the bottom surface and an upper chamfered surface between each of the side surfaces and the upper surface.

The heat insulation part for the liquefied gas storage tank according to the first embodiment includes a first density region 10 and a second density region 12 based on the density of a heat insulation panel constituting the heat insulation part. The bottom surface of the heat insulation part for the liquefied gas storage tank corresponds to the first density region 10, and the other surfaces of the heat insulation part, including the upper and lower chamfered surfaces, correspond to the second density region 12. Here, a heat insulation panel disposed in the second density region 12 may have a higher density than a heat insulation panel disposed in the first density region 10.

For example, the heat insulation panel disposed in the first density region 10 may have a density of about 130 kg/m$^3$, and the heat insulation panel disposed in the second density region 12 may have a density of about 210 kg/m$^3$.

The heat insulation part for the liquefied gas storage tank according to the first embodiment may be used in an offshore floating vessel fueled by liquefied gas. As the offshore floating vessel fueled by liquefied gas is operated, the amount of the liquefied gas in a liquefied gas storage tank of the offshore floating vessel is gradually decreased. Thus, the storage tank is impacted by sloshing at varying portions thereof during operation of the offshore floating vessel. In other words, in an early stage of operation in which a relatively large amount of the liquefied gas is stored in the liquefied gas storage tank, an upper portion of each of front and back surfaces, side surfaces, an upper chamfered surface, and an upper surface of the liquefied gas storage tank are impacted by sloshing, whereas, in a later stage of operation in which the amount of the liquefied gas in the liquefied gas storage tank is decreased, a lower portion of each of the front and back surfaces, the side surfaces, and a lower chamfered surface of the liquefied gas storage tank are impacted by sloshing.

On the other hand, factors of liquefied gas-induced impact on the liquefied gas storage tank are mainly divided into (a) the load of the liquefied gas on a bottom surface of the liquefied gas storage tank and (b) sloshing of the liquefied gas against the upper surface, the side surfaces, the front surface, the back surface, or the upper and lower chamfered surfaces of the storage tank. Generally, the impact on the storage tank due to (b) is greater than the impact on the storage tank due to (a). Accordingly, the heat insulation panel disposed in the first density region 10 may have a relatively low density, whereas the heat insulation panel disposed in the second density region 12 may have a relatively high density.

FIG. 3 is a development view of a heat insulation part for a liquefied gas storage tank according to a second embodiment of the present invention.

Referring to FIG. 3, the heat insulation part for the liquefied gas storage tank according to the second embodiment of the present invention includes different density regions than the heat insulation part according to the first embodiment. In other words, a bottom surface and a lower chamfered surface of the heat insulation part correspond to a third density region 20, a central portion and lower portion of each of front and back surfaces and a side surface of the heat insulation part correspond to a fourth density region 22, and at least a portion of the upper surface, an upper portion of each of the front and back surfaces, and an upper chamfered surface of the heat insulation part correspond to a fifth density region 24. In addition, a central portion of the upper surface may correspond to a sixth density region 26, and thus the rest of the upper surface excluding the central portion may correspond to the fifth density region 24.

As shown in FIG. 3, the central portion of each of the front and back surfaces, corresponding to the fourth density region 22, may upwardly protrude toward the upper portion of each of the front and back surfaces, that is, the fifth density region 24; the sixth density region 26 may be formed in a rectangular shape at the central portion of the upper surface; and the fifth density region 24 may surround the rectangular sixth density region 26.

A heat insulation panel disposed in the fifth density region 24 may have a higher density than a heat insulation panel disposed in the fourth density region 22, and a heat insulation panel disposed in the fourth density region 22 may have a higher density than a heat insulation panel disposed in the third density region 20. In addition, a heat insulation panel disposed in the fifth density region 24 may have a higher density than a heat insulation panel disposed in the sixth density region 26.

For example, the heat insulation panel disposed in the third density region 20 may have a density of about 100 $kg/m^3$, the heat insulation panel in each of the fourth density region 22 and the sixth density region 26 may have a density of about 130 $kg/m^3$, and the heat insulation panel disposed in the fifth density region 24 may have a density of about 210 $kg/m^3$.

The heat insulation part for the liquefied gas storage tank according to the second embodiment may be used in an offshore floating vessel having a storage tank storing liquefied gas as a cargo, such as an LNG carrier. Unlike the liquefied gas storage tank according to the first embodiment, a liquefied gas storage tank of the offshore floating vessel storing or carrying a liquefied gas cargo is fully filled with liquefied gas or is empty. Thus, in the second embodiment of the present invention, it is not necessary that the entirety of the heat insulation part excluding the bottom surface be composed of a heat insulation panel having a relatively high density.

In the second embodiment, a heat insulation panel constituting at least a portion of the upper portion of each of the front and back surfaces, at least a portion of the upper surface, and the upper chamfered surface of the heat insulation part, which are heavily impacted by sloshing, may have a relatively high density; a heat insulation panel constituting the central portion and lower portion of each of the front and back surfaces, the side surfaces, and the central portion of the upper surface of the heat insulation part, which are relatively less impacted by sloshing, may have a relatively intermediate density; and a heat insulation panel constituting the bottom surface and the lower chamfered surface of the heat insulation part, which are mainly impacted by a load of liquefied gas while being impacted little by sloshing, may have a relatively low density.

An edge of the upper surface of the heat insulation part is relatively heavily impacted by sloshing, whereas the central portion of the upper surface is relatively less impact by sloshing. Accordingly, a heat insulation panel constituting the edge of the upper surface may have a relatively high density, and a heat insulation panel constituting the central portion of the upper surface may have a relatively low density.

Generally, a heat insulation panel attached to the liquefied gas storage tank has a rectangular shape. According to the present invention, the central portion of each of the front and back surfaces of the heat insulation part, corresponding to the fourth density region 22, may protrude in an angular rectangular shape toward the fifth density region 24, as shown in FIG. 3, such that the effects of the present invention can be achieved without a separate heat insulation panel having a shape other than a rectangular shape. In addition, the central portion of the upper surface of the heat insulation part, corresponding to the sixth density region 26, may have a rectangular shape such that the effects of the present invention can be achieved without a need to provide a separate heat insulation panel.

FIG. 4 is a development view of a heat insulation part for a liquefied gas storage tank according to a third embodiment of the present invention.

The heat insulation part for the liquefied gas storage tank according to the third embodiment shown in FIG. 4 is basically the same as the heat insulation part of the liquefied gas storage tank according to the second embodiment shown in FIG. 3. Thus, the following description will focus on the difference between the heat insulation part according to the third embodiment shown in FIG. 3.

Referring to FIG. 4, the heat insulation part for the liquefied gas storage tank according to the third embodiment further includes a seventh density region 28 formed at a lower portion of each of the front and back surfaces and the side surface thereof. A heat insulation panel disposed in the seventh density region 29 may have a higher density than a heat insulation panel disposed in the fourth density region 22. For example, the heat insulation panel constituting the seventh density region 28 may have a density of about 210 $kg/m^3$.

The heat insulation part for the liquefied gas storage tank according to the third embodiment may be used in an offshore floating vessel having a storage tank storing liquefied gas as a cargo, such as an LNG carrier, as in the second embodiment. However, the heat insulation part according to the third embodiment may be used in a storage tank having a different capacity than the storage tank to which the heat insulation part according to the second embodiment is applied.

When a relatively small amount of liquefied gas is stored in the storage tank, the lower portion of each of the front and back surfaces and the side surfaces of the heat insulation part can be heavily impacted by sloshing during carriage of liquefied gas. Accordingly, the heat insulation part according to this embodiment further includes the seventh density region 28 in which a heat insulation panel having a relatively high density is disposed at portions of the front, side and back surfaces of the heat insulation part below the fourth density region 22, thereby exhibiting improved durability.

Although some embodiments have been described herein, it should be understood that these embodiments are provided for illustration only and are not to be construed in any way as limiting the present invention, and that various modifications, changes, alterations, and equivalent embodiments can be made by those skilled in the art without departing from the spirit and scope of the invention. The scope of the present invention should be defined by the appended claims and equivalents thereof.

The invention claimed is:

1. A liquefied gas storage tank for storing liquefied gas, the liquefied gas storage tank comprising:

a membrane-type storage tank comprising liquid-contacting surfaces and a heat insulation part that is disposed underneath the liquid-contacting surfaces and configured to support the liquid-contacting surfaces, wherein the liquid-contacting surfaces comprise a bottom surface, a side surface, and a top surface, wherein the bottom surface is configured to support a weight of the liquefied gas stored in the liquefied gas storage tank;

wherein the heat insulation part comprises a bottom region supporting the bottom surface, a side region supporting the side surface, and a top region supporting the top surface;

wherein a plurality of heat insulation panels are arranged to form the bottom region, the side region, and the top region;

wherein at least one of the plurality of heat insulation panels that is disposed in the bottom region is made of at least a first heat insulation material having a first density;

wherein at least one of the plurality of heat insulation panels that is disposed in the side region is made of at least a second heat insulation material having a second density;

wherein at least one of the plurality of heat insulation panels that is disposed in the top region is made of at least a third heat insulation material having a third density;

wherein the first density of the first heat insulation material supporting the bottom surface is (i) lower than the second density of the second heat insulation material supporting the side surface such that the side surface is configured to withstand a greater amount of liquefied-gas-induced impact due to sloshing of the liquefied gas than the bottom surface, and (ii) lower than the third density of the third heat insulation material supporting the top surface such that the top surface is configured to withstand a greater amount of liquefied-gas-induced impact due to sloshing of the liquefied gas than the bottom surface;

wherein the liquid-contacting surfaces further comprise a front surface and a back surface that are each adjacent to the side surface;

wherein each of the front surface and the back surface comprises (I) an upper portion adjacent to the top surface and supported by a fourth heat insulation material, (II) a lower portion adjacent to the bottom surface and supported by a fifth heat insulation material having a lower density than that of the fourth heat insulation material, and (III) a central portion disposed between the upper portion and the lower portion and supported by a sixth heat insulation material having a lower density than that of both the fourth heat insulation material and the fifth heat insulation material;

wherein a boundary between the upper portion and the central portion of at least one of the front surface and the back surface includes a segment that is farther away from the lower portion of said at least one of the front surface and the back surface than another segment of the boundary; and wherein the top surface comprises (a) a peripheral portion supported by a seventh heat insulation material and (b) an inner portion that is surrounded by the peripheral portion and supported by the third heat insulation material having a lower density than that of the seventh heat insulation material supporting the peripheral portion of the top surface.

2. The liquefied gas storage tank according to claim 1, wherein the second density of the second heat insulation material in the side region is lower than the third density of the third heat insulation material in the top region.

3. The liquefied gas storage tank according to claim 1, wherein the top region of the heat insulation part comprises an inner portion in which the third heat insulation material is provided and a peripheral portion in which the seventh heat insulation material is provided and surrounds the inner region.

4. The liquefied gas storage tank according to claim 1, wherein the second heat insulation material in the bottom region and the third heat insulation material in the top region are the same.

5. The liquefied gas storage tank according to claim 1, wherein the second heat insulation material in the bottom region is different from the third heat insulation material in the top region, and the second density is different from the third density.

6. The liquefied gas storage tank according to claim 1, wherein the first heat insulation material supporting the bottom surface of the membrane-type storage tank has a density lower than the second density and the third density throughout the entire bottom region including a central portion of the bottom region and edges of the bottom region.

7. The liquefied gas storage tank according to claim 1, wherein the liquefied gas storage tank exhibits a density gradient across the liquid-contacting surfaces of the liquefied gas storage tank, wherein the density gradient comprises:

(a) a first increase in density from the bottom surface to the lower portion of the back surface, wherein the first increase causes the lower portion of the back surface to be able to withstand a greater amount of liquefied-gas-induced impact due to sloshing of the liquefied gas near a bottom of the liquefied gas storage tank than the bottom surface;

(b) a first decrease in density from the lower portion of the back surface to the central portion of the back surface, wherein the first decrease causes the lower portion of the back surface to be able to withstand a greater amount of liquefied-gas-induced impact due to sloshing of the liquefied gas near the bottom of the liquefied gas storage tank than the central portion of the back surface;

(c) a second increase in density from the central portion of the back surface to an upper portion of the back surface, wherein the second increase causes the upper portion of the back surface to be able to withstand a greater amount of liquefied-gas-induced impact due to sloshing of the liquefied gas near a top of the liquefied gas storage tank than the central portion of the back surface; and (d) a second decrease in density from the peripheral portion of the top surface to the inner portion of the top surface, wherein the second decrease causes the peripheral portion of the top surface to be able to withstand a greater amount of liquefied-gas-induced impact due to sloshing of the liquefied gas near the top of the liquefied gas storage tank than the inner portion of the top surface.

8. The liquefied gas storage tank according to claim 7, wherein the liquefied gas storage tank exhibits a density gradient across the liquid-contacting surfaces of the liquefied gas storage tank, wherein the density gradient comprises:

(I) a first increase in density from the bottom surface to the lower portion of the front surface, wherein the first increase causes the lower portion of the front surface to be able to withstand a greater amount of liquefied-gas-induced impact due to sloshing of the liquefied gas near a bottom of the liquefied gas storage tank than the bottom surface;

(II) a first decrease in density from the lower portion of the front surface to the central portion of the front surface, wherein the first decrease causes the lower portion of the front surface to be able to withstand a greater amount of liquefied-gas-induced impact due to sloshing of the liquefied gas near the bottom of the liquefied gas storage tank than the central portion of the front surface; and (III) a second increase in density from the central portion of the front surface to the upper portion of the front surface, wherein the second increase causes the upper portion of the front surface to be able to withstand a greater amount of liquefied-gas-induced impact due to sloshing of the liquefied gas near a top of the liquefied gas storage tank than the central portion of the front surface, wherein the density gradient from the bottom surface to the back surface and across the back surface is substantially similar to the density gradient from the bottom surface to the front surface and across the front surface.

9. The liquefied gas storage tank according to claim 7, wherein a set of heat insulation materials disposed underneath the back surface to provide the density gradient across the back surface are disposed at the same or substantially the same depth from the back surface.

10. The liquefied gas storage tank according to claim 1, wherein the top surface exhibits a density gradient despite being unaffected by a load applied on the top surface due to the weight of the liquefied gas stored in the liquefied gas storage tank, wherein the density gradient comprises a decrease in density from the peripheral portion of the top surface to the inner portion of the top surface such that the peripheral portion outer of the top surface is configured to withstand a greater amount of liquefied-gas-induced impact due to sloshing of the liquefied gas near a top of the liquefied gas storage tank than the inner portion of the top surface.

11. The liquefied gas storage tank according to claim 1, wherein the side surface exhibits a density gradient, wherein the density gradient comprises a decrease in density from a lower portion of the side surface to an upper portion of the top surface such that the lower portion of the side surface is configured to withstand a greater amount of liquefied-gas-induced impact due to sloshing of the liquefied gas near a bottom of the liquefied gas storage tank than the upper portion of the side surface.

12. The liquefied gas storage tank according to claim 1, wherein the top surface and the bottom surface face each other.

13. The liquefied gas storage tank according to claim 12, wherein an inner portion of the bottom surface that is directly across from and faces the inner portion of the top surface and a peripheral portion of the bottom surface that is directly across from and faces the peripheral portion of the top surface are both supported by the first heat insulation material having the same density, despite the inner portion and the peripheral portion of the top surface being supported by heat insulation materials having different densities.

14. The liquefied gas storage tank according to claim 13, wherein a density gap between the inner portion of the bottom surface and the inner portion of the top surface is smaller than a density gap between the peripheral portion of the bottom surface and the peripheral portion of the top surface.

15. The liquefied gas storage tank according to claim 1, wherein the segment that is farther away from the lower portion overlaps with the inner portion of the top surface along a direction perpendicular to the side surface.

16. The liquefied gas storage tank according to claim 1, wherein the segment that is farther away from the lower portion juts out towards the top surface and is closer to the top surface than the rest of the boundary.

17. The liquefied gas storage tank according to claim 1, wherein the liquid-contacting surfaces further comprise two lower chamfered surfaces that are each adjacent to the bottom surface, wherein the two lower chamfered surfaces are supported by the first heat insulation material having the first density that is lower than that of the fifth heat insulation material supporting the lower portion of the bottom surface that is adjacent to both of the two lower chamfered surfaces.

18. A method of arranging a heat insulation part for a membrane-type liquefied gas storage tank for storing liquefied gas, the method comprising:

dividing the heat insulation part into a bottom region for supporting a bottom surface of the membrane-type liquefied gas storage tank, a side region for supporting a side surface of the membrane-type liquefied gas storage tank, a top region for supporting a top surface of the membrane-type liquefied gas storage tank, a front region for supporting a front surface of the membrane-type liquefied gas storage tank, and a back region for supporting a back surface of the membrane-type liquefied gas storage tank; and disposing at least a first heat insulation material in the bottom region, wherein the first heat insulation material has a first density;

disposing at least a second heat insulation material in the side region, wherein the second heat insulation material has a second density; and disposing at least a third heat insulation material in the top region, wherein the third heat insulation material has a third density, wherein the first density of the first heat insulation material supporting the bottom surface is (i) lower than the second density of the second heat insulation material supporting the side surface such that the side surface is configured to withstand a greater amount of liquefied-gas-induced impact due to sloshing of the liquefied gas than the bottom surface, and (ii) lower than the third density of the third heat insulation material supporting the top surface such that the top surface is configured to withstand a greater amount of liquefied-gas-induced impact due to sloshing of the liquefied gas than the bottom surface;

wherein the front surface and the back surface are each adjacent to the side surface;

wherein each of the front surface and the back surface comprises (I) an upper portion adjacent to the top surface and supported by a fourth heat insulation material, (II) a lower portion adjacent to the bottom surface and supported by a fifth heat insulation material having a lower density than that of the fourth heat insulation material, and (III) a central portion disposed between the upper portion and the lower portion and supported by a sixth heat insulation material having a lower density than that of both the fourth heat insulation material and the fifth heat insulation material;

wherein a boundary between the upper portion and the central portion of at least one of the front surface and the back surface includes a segment that is farther away from the lower portion of said at least one of the front surface and the back surface than another segment of the boundary; and wherein the top surface comprises (a) a peripheral portion supported by a seventh heat insulation material and (b) an inner portion that is surrounded by the peripheral portion and supported by the third heat insulation material having a lower density than that of the seventh heat insulation material supporting the peripheral portion of the top surface.

19. The method according to claim 18, wherein the heat insulation part comprises reinforced polyurethane foam (R-PUF).

20. The method according to claim 18, further comprising disposing the sixth heat insulation material in a first portion of the side region that is closer to the bottom surface of the membrane-type liquefied gas storage tank than a second portion of the side region in which the second heat insulation material is disposed, wherein the sixth heat insulation material has a fourth density that is greater than the second density of the second heat insulation material such that the first portion of the side region is configured to withstand a greater amount of liquefied-gas-induced impact due to sloshing of the liquefied gas near a bottom of the membrane-type liquefied gas storage tank than the second portion of the side region.

21. The method according to claim 20, further comprising:

disposing the fourth heat insulation in an upper portion of a back region for supporting the back surface of the membrane-type liquefied gas storage tank;

disposing the fifth heat insulation in a lower portion of the back region; and disposing the sixth heat insulation in a central portion of the back region, wherein the back surface exhibits a density gradient comprising (a) a decrease in density from the upper portion of the back region to the central portion of the back region, wherein the decrease in density causes the upper portion of the back region to be able to withstand a greater amount of liquefied-gas-induced impact due to sloshing of the liquefied gas near a bottom of the membrane-type liquefied gas storage tank than the central portion of the back region, and (b) an increase in density from the central portion of the back region to the lower portion of the back region, wherein the increase in density causes the third portion of the lower region to be able to withstand a greater amount of liquefied-gas-induced impact due to sloshing of the liquefied gas near a top of the membrane-type liquefied gas storage tank than the central portion of the back region.

* * * * *